US007750770B2

(12) United States Patent
Duchrow et al.

(10) Patent No.: US 7,750,770 B2
(45) Date of Patent: Jul. 6, 2010

(54) GAS DIVERTER FOR AN ELECTRICAL SWITCHING DEVICE

(75) Inventors: Robert A. Duchrow, Menomonee Falls, WI (US); Phillip Bush, Milwaukee, WI (US); James P. Miller, Waukesha, WI (US); Theodore John Houck, III, Milwaukee, WI (US); William R. Berry, Menomonee Falls, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 863 days.

(21) Appl. No.: 11/526,404

(22) Filed: Sep. 25, 2006

(65) Prior Publication Data

US 2008/0074217 A1 Mar. 27, 2008

(51) Int. Cl.
*H01H 9/30* (2006.01)

(52) U.S. Cl. ..... 335/202; 335/201

(58) Field of Classification Search ..... 335/201, 335/202; 200/10; 218/35, 51, 52, 157
See application file for complete search history.

(56) References Cited

U.S. PATENT DOCUMENTS 4,559,423 A * 12/1985 Yamagata et al. ..... 218/157
5,731,561 A * 3/1998 Manthe et al. ..... 218/35
6,037,555 A * 3/2000 Castonguay et al. ..... 218/157
6,417,749 B1 7/2002 Kappel et al.
6,960,736 B1 * 11/2005 Bach et al. ..... 218/155

OTHER PUBLICATIONS

Rockwell Automation, Bulletin 100-D IEC Contactors; website: http://www.ab.com/en/epub/cataogs/12768/229254/229461/494416/, Sep. 25, 2006.

* cited by examiner

*Primary Examiner*—Ramon M Barrera
(74) *Attorney, Agent, or Firm*—Fletcher Yoder LLP; Alexander R. Kuszewski; John M. Miller

(57) ABSTRACT

A gas diverter is disclosed that slows, cools, and directs the hot gas and plasma generated during the operation of an electrical switching device. The gas diverter mounts to the switching device and has an inlet for accepting the gas and exit for expelling the gas. The diverter has peripheral walls and internal partitions that divide the gas and provide for two independent circuitous flow paths. In multi-phase switching devices, a plurality of gas diverters may be used to further separate the gases generated in each respective phase. The gas diverter is made of a high temperature, arc resistant plastic which is molded to form a two piece structure. The gas diverter is mounted to the device via a slide in place flange-channel mechanism.

16 Claims, 5 Drawing Sheets

GAS DIVERTER FOR AN ELECTRICAL SWITCHING DEVICE

BACKGROUND

The present invention relates generally to the field of electrical contactors, circuit interrupters, circuit breakers, and similar devices. More particularly, the invention relates to a gas diverter used to slow, cool, and divert hot gas generated during the operation of electrical switching devices.

A variety of electrical switching devices are known and commercially available for establishing and interrupting current carrying paths between an electrical energy source and an electrical load. Electromechanical switchgear, for instance, is known for both single-phase and multiple-phase circuits. Such equipment generally includes an actuating assembly mechanically connected to a switch or contactor structure. In remotely-controllable switchgear of this type, it is commonplace to provide an electromagnetic actuating assembly which operates either on alternating current or direct current. The actuating assembly is energized by a control signal, such as from a remote controller. Electrical current through the actuating assembly causes movement of an armature under the influence of an electromagnetic field generated by an actuating coil. A carrier coupled to the armature, moves the movable contacts to either open or close the current-carrying path through the device. Depending upon whether the device is configured to be normally-open or normally-closed, the armature either separates the moveable contacts from the stationary contacts or brings the contacts together when the control signal is applied.

In industrial contactors of the type described above, the elements of the contact assembly may be subjected to a number of opening and closing cycles. During each operating cycle, arcs are produced between the movable contacts and the stationary contacts. In high power applications, the arcs produced generate a significant amount of electrical energy which is thereby converted into thermal energy. It is during this conversion process that the relatively non-conductive ambient atmosphere confined inside the switching device undergoes ionization and becomes a highly conductive hot gas and plasma.

The hot gas and plasma is generally permitted to escape from switchgear though splitter plates and holes in the device housing. Concerns in such situations include potential phase-to-phase short circuits in multi-phase devices, and the release of hot gases. The ionized gas that may exit the devices is generally conductive and could lead to short circuits if similar ionized gas exits from neighboring phase sections of the devices. The diffuse nature of the gas and plasma allow it to flow in a variety of directions providing for a vast number of possible short circuit paths. Certain devices include short dividers coupled to the outer surface of the housing intended to separate ionized and hot gases. However, these do not generally divert or cool the gas.

There is a need, therefore, for improved switching devices and structures associated with such devices. In particular, there is a need for improved techniques for directing and cooling hot gases and plasma created during opening or closing of contacts in such devices.

BRIEF DESCRIPTION

The present invention provides an improved gas handling arrangement designed to respond to such needs. The invention provides an innovative approach for slowing, cooling, and diverting high temperature gas and plasma generated by switching devices. The invention provides a gas diverter that mounts to the switching device and has an inlet for accepting gas and exit for expelling the gas. The gas diverter further has peripheral walls and internal partitions that provide a circuitous flow path that slows, cools, and diverts the gas before release. In one embodiment, the housing has two independent flow paths thereby increasing the control of the dynamics of the gas, resulting in an increase in the convection cooling efficiency.

In a multi-phase contactor, a plurality of gas diverters may be used to further separate the expelled gas, thereby greatly reducing the possibility of a phase-to-phase short circuit, while reducing the overall length profile of the switching device assembly. This allows for a reduction in the size of dividing panels or even eliminates the need for such panels altogether.

The gas diverter may be molded from a high temperature, arc resistant plastic, such as in a two piece structure, making it economical to manufacture. In one embodiment, the diverter incorporates a flange-channel structure that may be slid into a housing channel formed in the switching device, allowing it to be easy implemented into a switching device.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
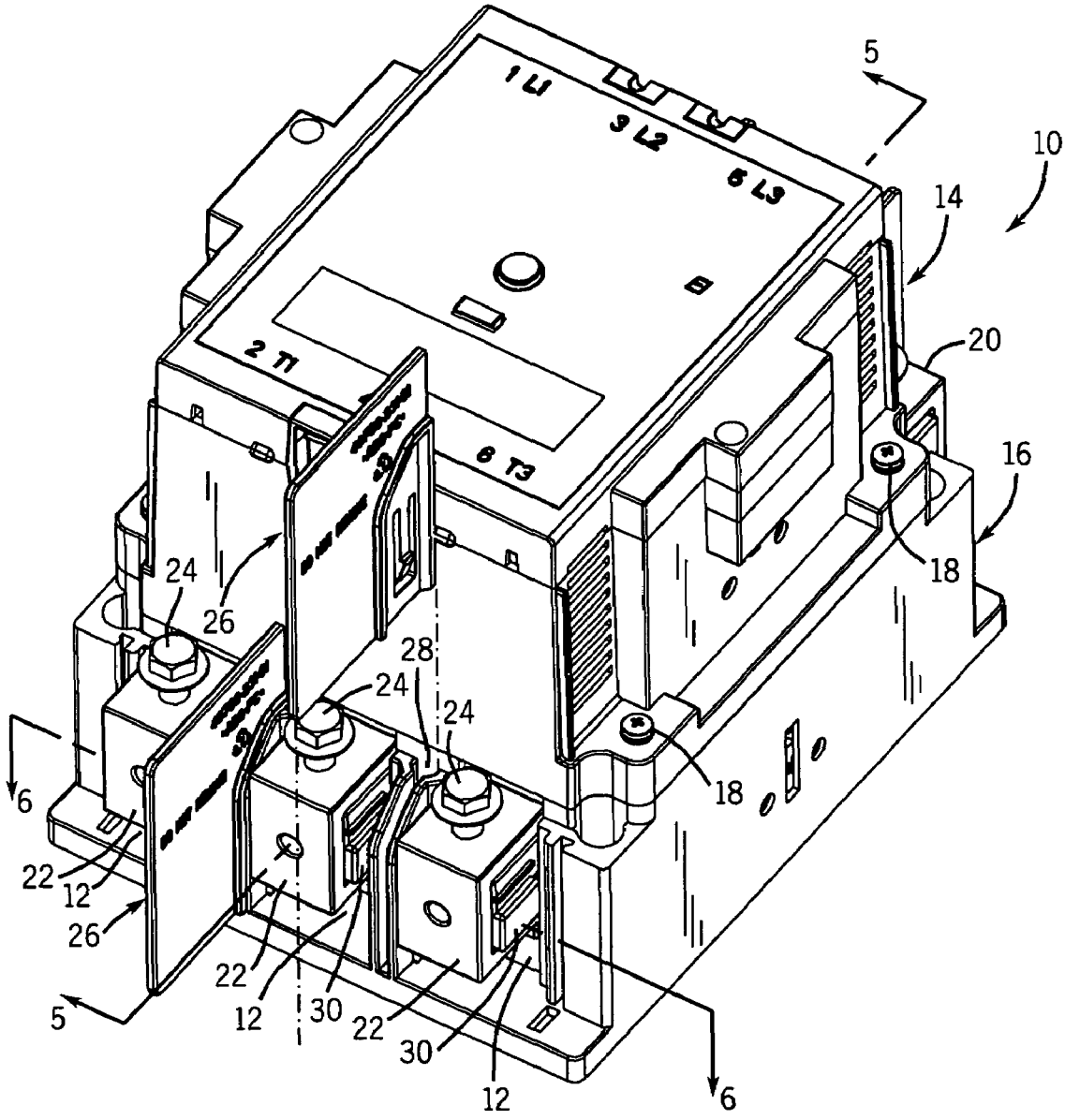
FIG. 1 is a perspective view of a three phase electrical switching device illustrating the location of exemplary gas diverters with respect to the switching device in accordance with certain aspects of the invention.

Turning now to the drawings, FIG. 1 illustrates an electrical switching device 10 in the form of a three-phase contactor for completing electrical current carrying paths for three separate phases 12 of electrical power. The switching device 10 includes an actuating section 14 and a contacting section 16 joined by fasteners 18. The actuating section contains the electromagnetic operator that mechanically opens and closes current carrying paths through the device. The operation and relevant internal components of the device will be discussed in more detail below. In general, however, each phase section 12 has an input or line terminal 20 and output or load terminal 22. Wire lugs 24 are secured to both the input and output terminals for receiving and completing an electrical connection with current-carrying wires or cables of a conventional design. Dividing panels or phase barriers 26 may be used to isolate vented gas from one phase from the neighboring phase. The phase barriers 26 are installed into slots 28 located in the contacting section 16. As will be discussed below, the invention allows the dividing panels to be reduced in size or possibly even eliminated, thereby reducing the required space needed to implement the switching device.

A gas diverter 30 is located at each terminal for both the input side 20 and output side 22. The gas diverter 30 slows, cools, and diverts the gas and plasma generated by the device before expelling it into the ambient environment, as discussed below.

Figure 2:
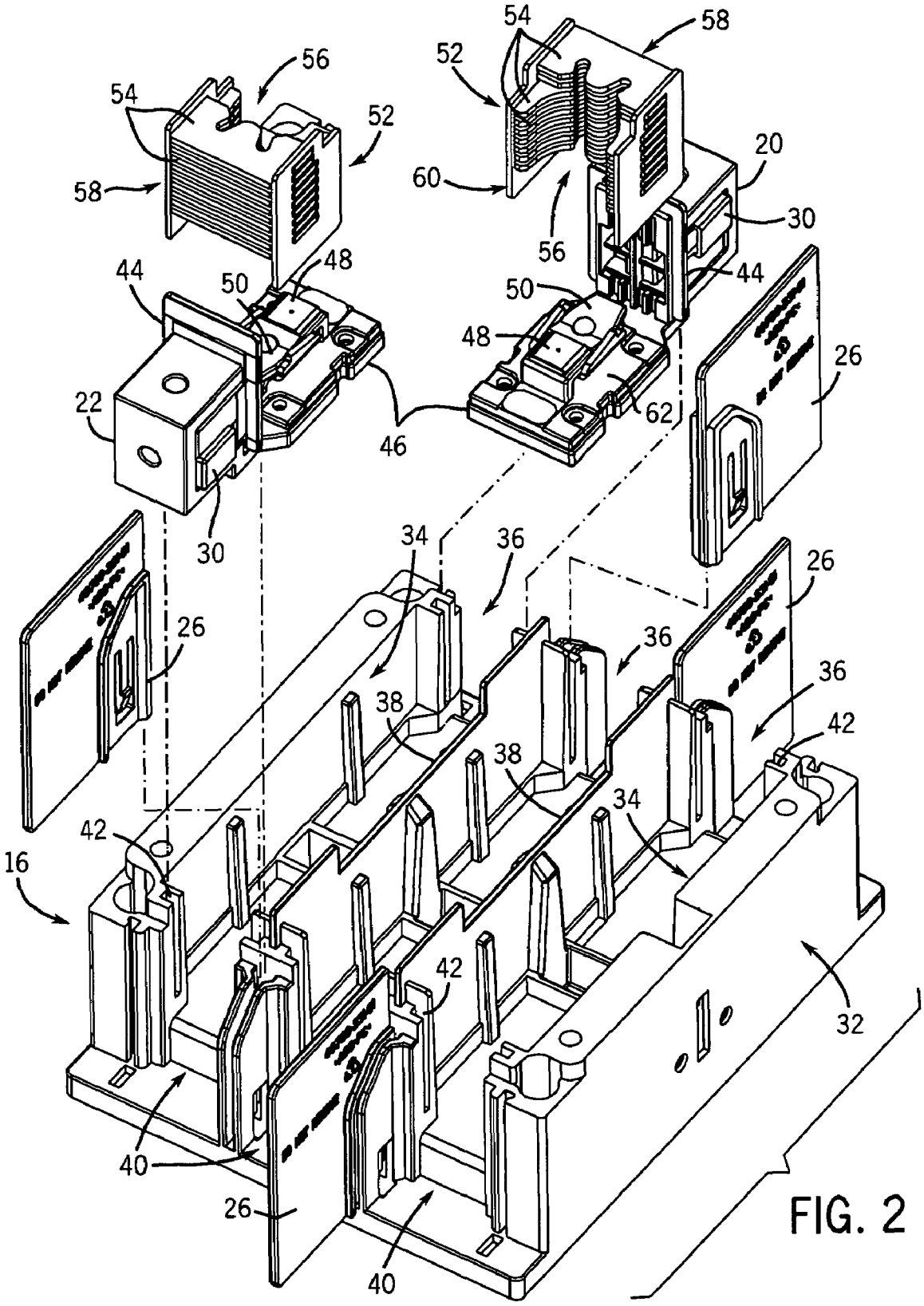
FIG. 2 is a exploded perspective view of the contacting section of the three phase switching device of FIG. 1, in which the actuating section has been removed to illustrate the contact housing, two terminals, two splitter plate assemblies, and two gas diverters.

FIG. 2 illustrates the contacting section 16 of the electrical switching device with the relevant parts of the contacting section exploded for explanatory purposes. The actuating section 14 (see FIG. 1) has been removed for clarity. Only two of the six terminals, splitter plate assemblies, and gas diverters are illustrated in FIG. 2. The contact housing 32 has an external wall 34 and is divided into three sections 36 by internal partitions 38. The partitions and walls serve to physically isolate the three phase sections from one another and the surrounding environment. The contact housing 32 has openings 40 in the exterior wall allowing the input and output terminals 20 and 22 to project outside of the housing. In the illustrated embodiment, the housing has channels 42 at each opening 40 configured to capture and orient the gas diverter 30 via a flange 44 extending from the diverter.

Each input terminal 20 and output terminal 22 has a bottom plate 46 used to mount the terminal to the contact housing 32. A stationary contact pad 48 is located on the terminal and serves as the stationary contact point that allows electrical current to flow through the device. When the switching device is opened, a turnback 50 directs the resulting electrical arc to a splitter plate assembly 52. The splitter plate assembly is configured with a plurality of splitter plates 54 that are stacked to allow the generated gas and plasma to flow therebetween. The gas and plasma enter the splitter plates on the entry side 56, flow to the exit side 58, and then into the gas diverter 30. The splitter plate assembly has an exterior wall 60 that engages a lip 62 on the terminal, locating the splitter plates over the stationary contact assembly.

Figure 3:
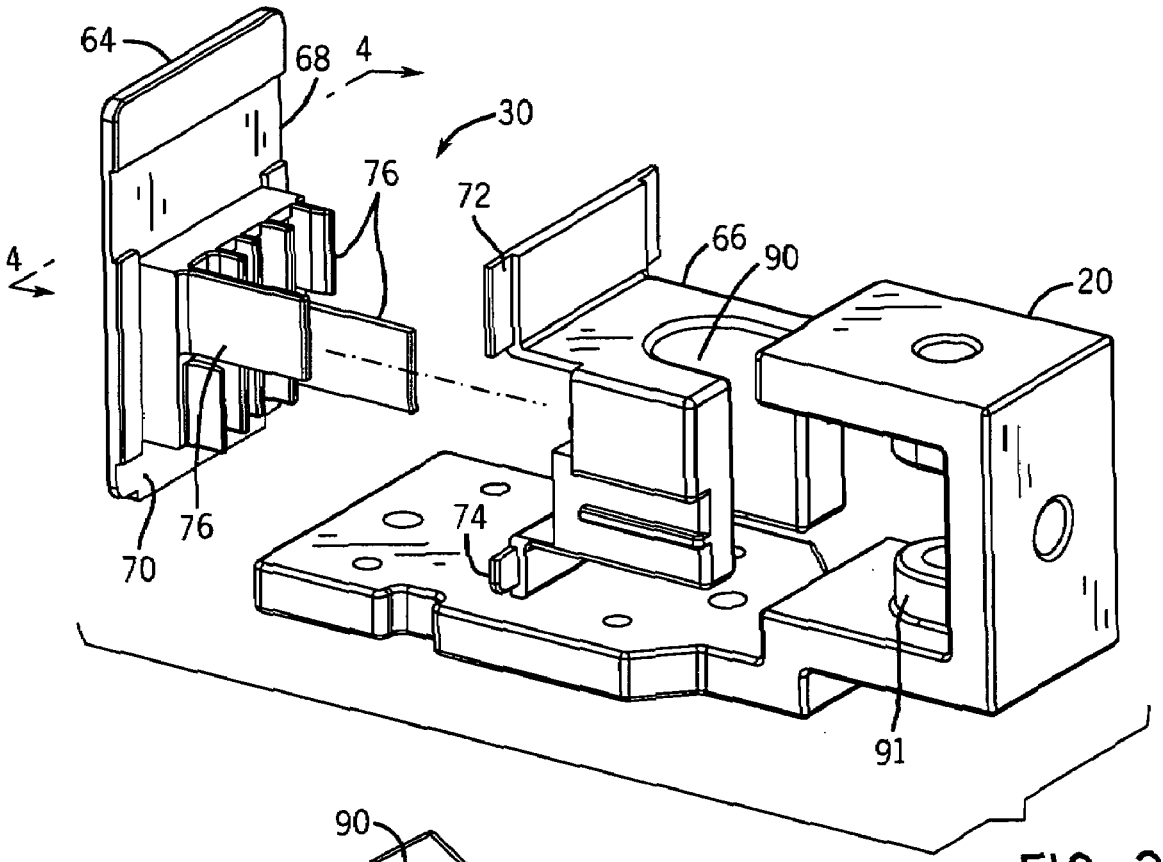
FIG. 3 is an exploded perspective view of the gas diverter and terminal of FIG. 2; illustrating the elements of the gas diverter in accordance with an exemplary embodiment.

The gas diverter 30 and exemplary terminal 20 are illustrated in an exploded view in FIG. 3. The gas diverter 30 has two mating housing elements, a first housing or front element 64 and a second element or housing 66. The front element 64 has an upper recess 68 and a lower recess 70. The housing has upper and lower panels 72 and 74 that enter into and mate with these recesses. Once the elements are joined, the panels and the wall of element 64 form a single solid flange 44 that positions and orients the gas diverter in the contact housing 32 via the channels 42. (See FIG. 2). The simple and effective flange channel mechanism allows for quick and easy installation of the gas diverter. Those skilled in the art will appreciate that there are a number of different mounting arrangements that could be used as alternatives to the particular construction illustrated. Partitions 76 extend from the back side of the front element 64 and form part of the flow path when mated with the housing 66, as described below.

Figure 4:
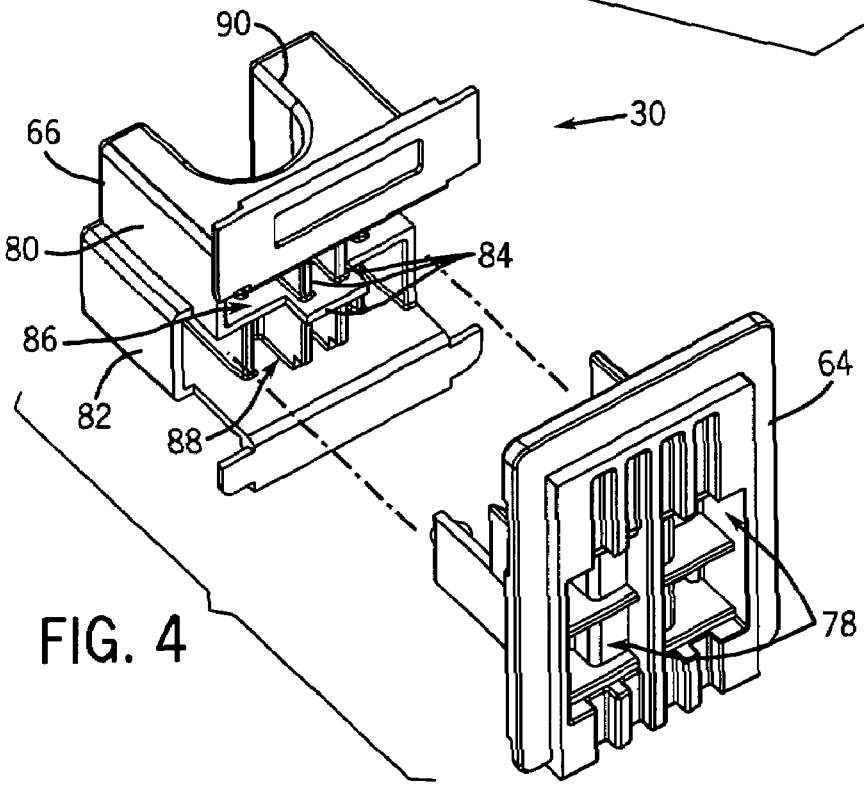
FIG. 4 is an exploded perspective view of the gas diverter of FIG. 3; shown from the perspective of line 4-4, the terminal shown in FIG. 3 having been removed.

In the view shown in FIG. 4, the terminal 20 has been removed and the gas diverter is viewed from the perspective of line 4-4 shown in FIG. 3. The opening 78 in the front element 64 serves as the gas inlet for the diverter 30. The housing 66 has exterior walls 80 that contain the gas and plasma with a further raised section 82 that provides for a gas exit. When the front element 64 is mated with the housing 66, the internal partitions 84 result in an upper flow path 86 and lower flow path 88. While the current embodiment provides for two flow paths, those skilled in the art will appreciate that the number and configuration of partitions 76 and internal partitions 84 could be varied to provide for more than two flow paths. Certain of the partitions could also be removed or configured to provide a single flow path, or flow paths that are otherwise configured.

The housing 66 is provided with an arcuate indention 90 allowing it to interface with mating features 91 in the terminal 20. The housing is not limited to this shape and can be configured to accommodate a number of different shapes and sizes.

In the current embodiment the housing elements are made from high temperature, arc resistant moldable plastic. Those skilled in the art will readily appreciate that the invention is not functionally limited to any specific material choices and any suitable material could be used for the housing elements. Furthermore, while the current design is a two piece assembly, alternative designs could include more than two pieces, or the diverter could be molded as a single piece, such as via the use of mold cores and so forth.

Figure 5:
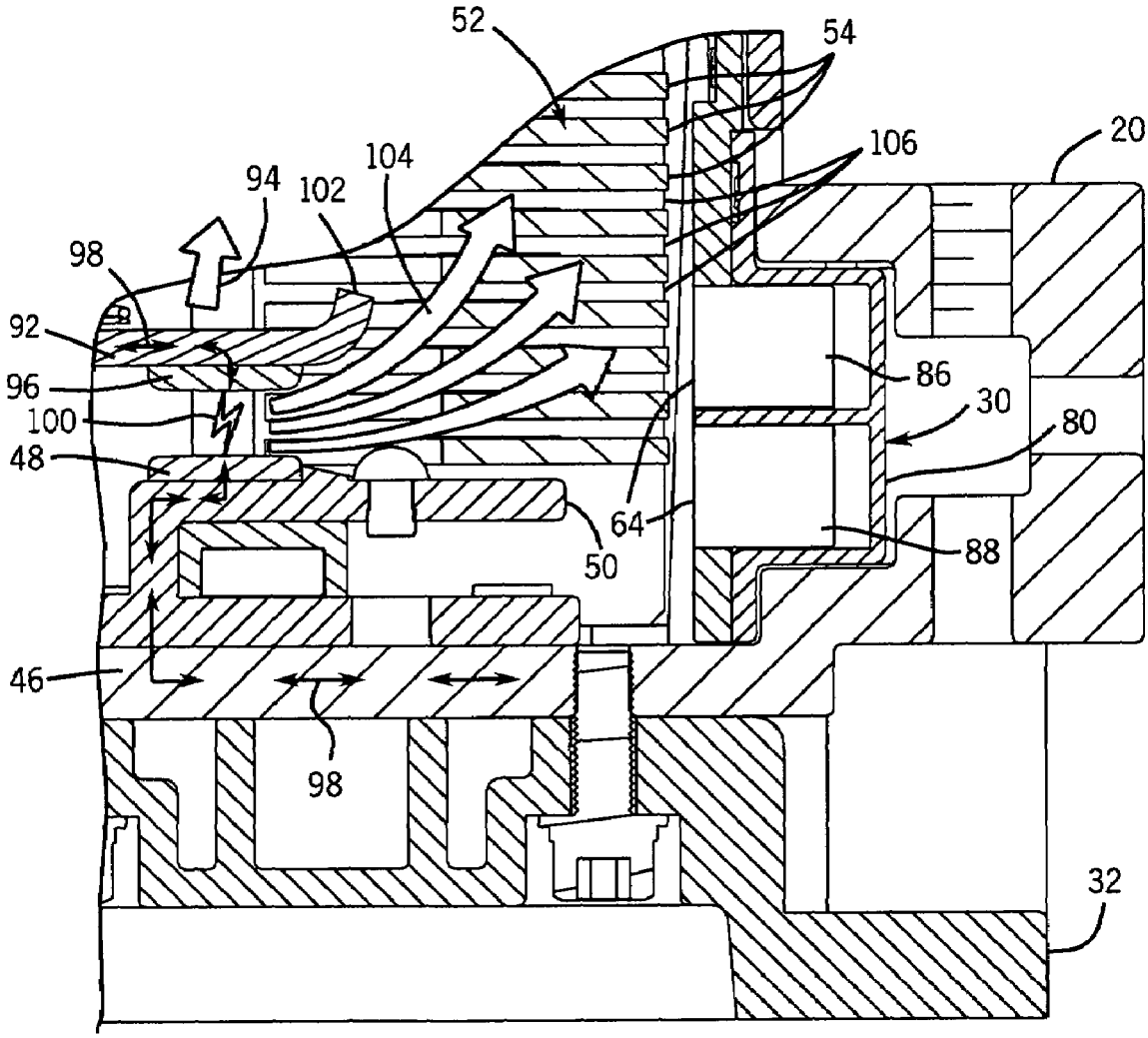
FIG. 5 is a sectional view of the three phase switching device of FIG. 1, sectioned along line 5-5, illustrating the relative location of the contacts, splitter plates, and gas diverter during the arc dissipation process.

FIG. 5 is a partial sectional view of the switching device 10 from FIG. 1, sectioned along lines 5-5, illustrating the switching device opening and thereby causing a break in the current flow path. The switching device is opened when an electromechanical operator attached to the movable contact assembly 92 is released, typically by de-energization of an operator coil, and mechanically separates the movable contact pad 96 from the stationary contact pad 48, as indicated by reference numeral 94. This in turns interrupts the electrical current from flowing through the device, as indicated by arrow 98, and creates an electrical arc 100 between the two pads.

As discussed above, the arc produces significant heating through the release of electrical energy that is dissipated by the splitter plate assembly 52 as the arc is driven into the splitter plates. The turn back 50 and arc guide 102 typically direct the arc 104 to the splitter plates 54 magnetically, whereby the electrical energy is converted into thermal energy. Gases within the device may be ionized by the arc, creating plasma that is also driven towards the splitter plates. As a result of flow dynamics, the gas and plasma flow through the gaps 106 in the splitter plate assembly 52 and into either the upper 86 or lower section 88 of the gas diverter assembly 30 via the opening in the front element 64. The gas is contained within the gas diverter 30 by the exterior walls 80 and is directed in a specific direction with respect to the terminal 20.

Figure 6:
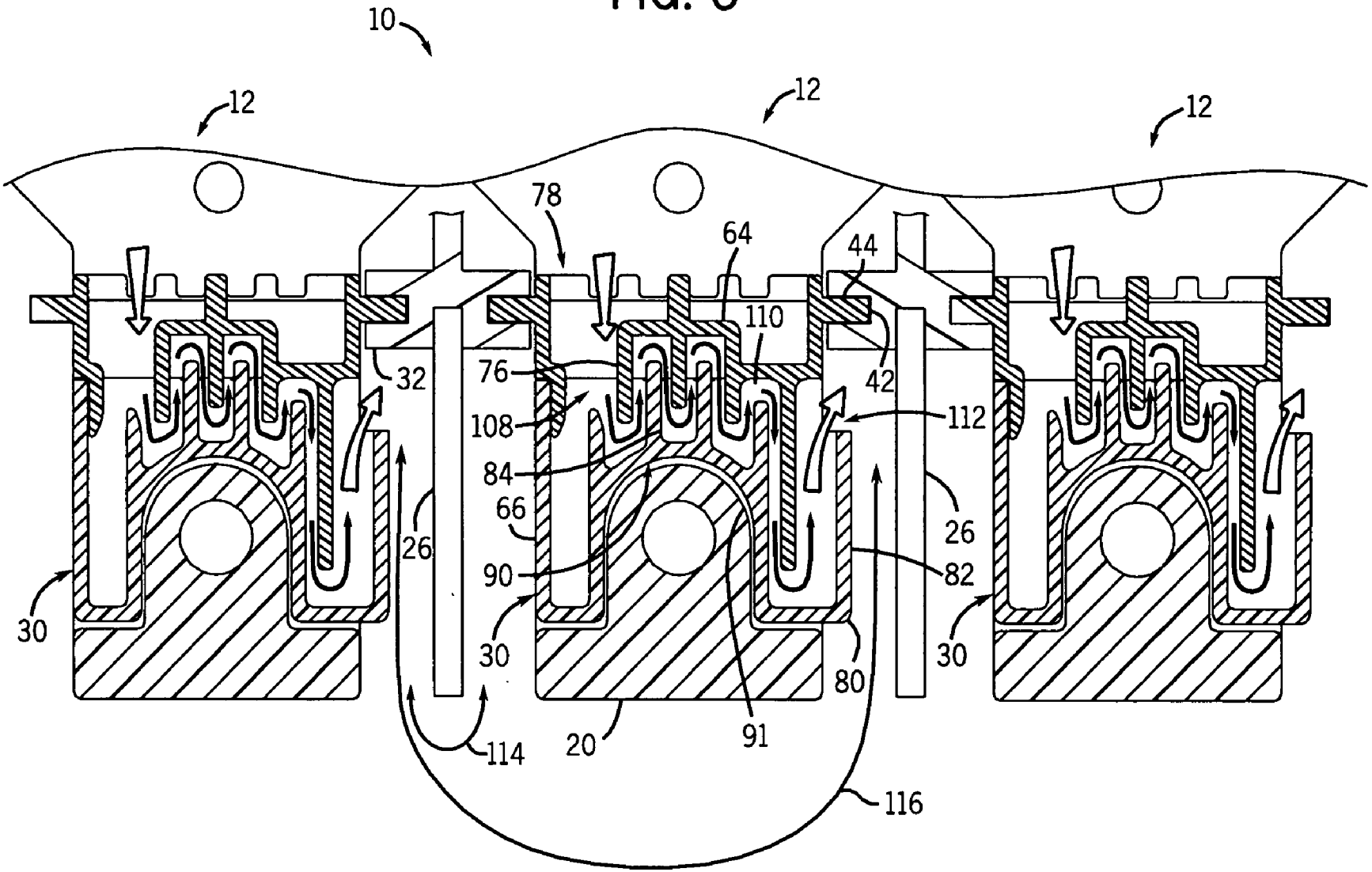
FIG. 6 is a sectional view of the three phase switching device of FIG. 1, sectioned along line 6-6, illustrating the gas flow path through the gas diverter assemblies and the resultant increased length of the phase-to-phase short circuit path.

FIG. 6 is a partial sectional view of the switching device 10 from FIG. 1, sectioned along lines 6-6, illustrating one of the gas flow paths through the diverter 30 for each respective phase section 12. The figure is exemplary of either the input side 20 or the output side 22 of the switching device 10 of FIG. 1. The figure illustrates three gas diverters 30 installed in the contact housing 32 via the flanges 44 and channels 42.

As discussed above, the gas and plasma enter the diverter 30 at the inlet 108 via the opening 78 in the front element 64. The partitions 76 extending from the front element 64 are interleaved with the internal partitions 84 contained in the housing 66 to form the flow paths 110. The flow paths 110 confine and divert the hot gas and plasma through a circuitous path, thereby slowing and cooling them before expelling the gas at the exit 112. The flow paths consist of generally parallel channels with 180 degree turnbacks on each respective end. Those skilled in the art will appreciate that a number of different configurations could be used to direct, divert and cool these gases and plasma. For example, a conical or spiral pattern or a variation of the parallel chambers could be used to create a number of different flow path configurations. Thus, the present invention is not functionally limited to any particular flow path arrangement. Furthermore, the gas flow for the current configuration is directed back towards the switching device 10 and thus away from possible temperature sensitive components and/or ignitable structures adjacent to the device. Those skilled in the art will appreciate that the flow may ultimately be directed back towards the switching device, or upwards, downwards, or away from the switching device. However, the illustrated embodiment enables released gas and any remaining plasma from each phase section to be effectively separated. Moreover, those skilled in the art will appreciate that the diverters achieve a very substantial effective length for cooling the gases and plasma, particularly as compared to known arrangement that simply release these into the immediate environment of the switching device. As noted above, in a present embodiment, flow paths are provided in upper and lower positions such that the flow of gas and plasma from the switching device is split between the upper and lower paths. Although not represented in FIG. 6, where provided, the upper flow path may be the same as, or as in a present embodiment, the opposite of the lower flow path. That is, while the lower flow path routes gas towards exit 112 on one side of the diverter, the upper flow path may route gas to an opposite side for venting.

Phase barriers 26 are shown in FIG. 6 for illustrative purposes. Those skilled in the art will appreciate that the phase-to-phase short circuit path has been significantly increased via the invention, as compared with prior art arrangements. That is, in known arrangements employing dividing panels alone, the phase-to-phase short circuit path is simply the length around the dividing panel, as indicated by arrow 114. Such arrangements, therefore, may require panels of substantial length. The gas diverter, on the other hand, creates a phase-to-phase short circuit path that is significantly increased and is a combination of the internal flow path 110 of the diverter plus the distance around the terminal 20 and phase barrier 26, as indicated by reference numeral 116. Depending upon the application, the significant increase in the short circuit path allows for the reduction in length of the dividing panels, or even their elimination altogether. As a result, the required space to implement the device and the overall length of the switching device package is reduced.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A switching device, comprising:

a phase section having a stationary contact and a movable contact configured to complete and interrupt a current carrying path through the phase section;

a plurality of splitter plates disposed adjacent to the stationary contact allowing for the passage of a hot gas produced during an interruption in the current carrying path; and a gas diverter mounted to the switching device and located adjacent to the splitter plates, the gas diverter including a housing having an inlet for receiving the hot gas, a circuitous flow path for cooling and diverting the gas, and an exit for expelling the gas to the ambient environment, wherein the gas diverter includes a removable front element, the housing and the front element having a plurality of interleaved partitions having at least three generally parallel channels joined to one another by 180 degree turnbacks, thereby forming the circuitous flow path.

2. The switching device of claim 1, wherein the gas diverter includes a plurality of inlets and a plurality of exits, each respective inlet and exit being joined by at least one circuitous flow path.

3. The switching device of claim 1, wherein the gas is expelled towards the switching device.

4. The switching device of claim 1, wherein the device includes a plurality of electrical phase sections, each phase section having a line side and a load side and a respective gas diverter.

5. The switching device of claim 1, wherein the switching device includes channels configured to receive a flange extending from the gas diverter for mounting the gas diverter to the switching device.

6. An apparatus for directing and cooling a gas or plasma generated by an electrical component, comprising:

an electrical component generating a gas or plasma; and a closed unit mounted to the electrical component and having an inlet for receiving the gas or plasma, at least one circuitous flow path for cooling and diverting the gas or plasma, and an exit for expelling the gas or plasma to the ambient environment, wherein the closed unit includes an internal structure and a removable exterior shell, the internal structure and the exterior shell having a plurality of interleaved partitions having at least three generally parallel channels joined to one another by 180 degree turnbacks, thereby forming the at least one circuitous flow path.

7. The apparatus of claim 6, wherein the closed unit is configured to mount to the electrical component via a flange extending from the closed unit.

8. The apparatus of claim 6, wherein the closed unit has at least one continuous flow path from the inlet to the exit.

9. The apparatus of claim 6, wherein the at least one flow path is formed by joining at least two generally parallel channels having at least one opening between each channel.

10. The apparatus of claim 6, wherein a first side of the electrical component is configured to mount to a mounting plate, and the closed unit is configured to mount to a second side of the electrical component.

11. An electrical switching device, comprising:

a contact housing comprising three phase sections each having stationary contacts and movable contacts configured to complete and interrupt a current carrying path through the phase section;

a plurality of splitter plates disposed on opposite sides of the housing and adjacent to each of the stationary contacts allowing for the passage of a hot gas produced during an interruption in the current carrying path of each phase section; and a gas diverter mounted on each side of each phase section adjacent to the splitter plates, each gas diverter including a housing having an inlet for receiving the hot gas, a circuitous flow path for cooling and diverting the gas, and an exit for expelling the gas to the ambient environment.

12. The electrical switching device of claim 11, wherein the gas diverter includes a housing and a front element, the housing and the front element having interleaved partitions thereby forming at least one circuitous flow path.

13. The electrical switching device of claim 12, wherein the partitions define a flow path having at least three generally parallel channels joined to one another by 180 degree turn-backs.

14. The electrical switching device of claim 11, wherein the gas diverter includes a plurality of inlets and a plurality of exits, each respective inlet and exit being joined by at least one circuitous flow path.

15. The electrical switching device of claim 11, wherein the gas is expelled towards the electrical switching device.

16. The electrical switching device of claim 11, wherein the electrical switching device includes channels configured to receive a flange extending from the gas diverter for mounting the gas diverter to the electrical switching device.

* * * * *